US009932153B2

(12) United States Patent
Hsieh

(10) Patent No.: US 9,932,153 B2
(45) Date of Patent: Apr. 3, 2018

(54) CONTAINER THAT PREVENTS AN ILLEGAL OPERATION AND CAN BE EASILY IDENTIFIED AFTER BEING ILLEGALLY OPERATED

(71) Applicant: Albert Hsieh, Lukang Township, Changhua County (TW)

(72) Inventor: Albert Hsieh, Lukang Township, Changhua County (TW)

(73) Assignee: VIGOURPLASTIC CO., LTD., Lukang Township, Changhua County (TW)

( * ) Notice: Subject to any disclaimer, the term of this patent is extended or adjusted under 35 U.S.C. 154(b) by 194 days.

(21) Appl. No.: 14/944,563

(22) Filed: Nov. 18, 2015

(65) Prior Publication Data

US 2017/0137182 A1 May 18, 2017

(51) Int. Cl.
*B65D 43/02* (2006.01)
*B65D 55/02* (2006.01)

(52) U.S. Cl.
CPC ..... *B65D 43/0254* (2013.01); *B65D 55/024* (2013.01); *B65D 2543/0062* (2013.01); *B65D 2543/00842* (2013.01)

(58) Field of Classification Search
CPC ..... B65D 43/0254; B65D 2543/00842; B65D 2543/0062; B65D 43/00833
USPC ..... 220/270
See application file for complete search history.

(56) References Cited

U.S. PATENT DOCUMENTS

2007/0045317 A1* 3/2007 Rosender ..... B65D 43/0249 220/266
2010/0072217 A1* 3/2010 Parikh ..... B65D 55/024 220/833
2010/0181323 A1* 7/2010 Thaler ..... B65D 43/0254 220/574
2011/0000929 A1* 1/2011 Brown ..... B65D 43/162 220/810
2011/0174819 A1* 7/2011 Murphy ..... B65D 43/0254 220/270
2012/0292322 A1* 11/2012 Meyer ..... B65D 43/0258 220/270
2013/0160406 A1* 6/2013 Johnston ..... B65B 7/26 53/467
2017/0057706 A1* 3/2017 Wang ..... B65D 43/0237
2017/0121080 A1* 5/2017 Wang ..... B65D 55/024

* cited by examiner

*Primary Examiner* — James N Smalley
(74) *Attorney, Agent, or Firm* — Egbert Law Offices, PLLC

(57) ABSTRACT

A container, that prevents an illegal operation and can be easily identified after being illegally operated, includes a bowl-shaped base and a cover selectively closing the bowl-shaped base, wherein a pre-broken structure is formed on the cover and the cover cannot be smoothly detached from the bowl-shaped base before the pre-broken structure being damaged. For the market, the salesperson easily confirms that the container has been illegally operated and the illegally operated container is replaced in time for providing fresh good to the consumers. For the consumers, the illegally operated containers can be easily confirmed and eliminated through choosing for preventing from buying unsafe or stale goods, particularly foods.

10 Claims, 9 Drawing Sheets

CONTAINER THAT PREVENTS AN ILLEGAL OPERATION AND CAN BE EASILY IDENTIFIED AFTER BEING ILLEGALLY OPERATED

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a container, and more particularly to a container that prevents illegal operation and can be easily identified after being illegally operated.

2. Description of Related Art Including Information Disclosed Under 37 CFR 1.97 and 37 CFR 1.98.

Vacuum-formed plastic containers are usually made to have a box-shaped or a cup-shaped containing structure and are used in supermarkets for keeping food fresh. The plastic containers are transparent for the buyer to clearly see the contents, such as jelly-like, fruit or liquid foods and are provided to stimulate customer's buy intent. For containing liquid foods, the conventional plastic containers focus on the function of water-tight seal. The conventional plastic container usually includes a hollow body and a body for selectively closing the hollow body.

The conventional plastic containers are provided for containing instant foods. However, the conventional plastic container provides no function to stop illegal operation. The tamper-resistant/evident structures are very important for deterring theft and preventing the loss of product and income for the seller, as well as instilling consumer confidence in the integrity of the contents within the container and confidence in the ability of the seller and/or manufacturer to provide and maintain quality goods.

The present invention has arisen to mitigate and/or obviate the disadvantages of the conventional container used in the supermarket for containing fresh foods.

BRIEF SUMMARY OF THE INVENTION

The main objective of the present invention is to provide an improved container that prevents illegal operation and can be easily identified after being illegally operated.

To achieve the objective, the container in accordance with the present invention comprises a bowl-shaped base including an opening defined therein and a stair-shaped first locking structure surrounding the opening. The first locking structure is sequentially divided into a vertical portion and a horizontal portion, wherein a peripheral wall outwardly extends from an edge of the horizontal portion and a first protrusion laterally extends from the horizontal portion of the first locking structure. A cavity is defined in the first protrusion, wherein the cavity has an Ʊ-shaped cross-section (upside down capital omega symbol).

A cover selectively closes the opening of the bowl-shaped base and includes a stair-shaped second locking structure peripherally formed thereon, wherein the first locking structure and the second locking structure are complementally and air-tightly connected to each other when the cover closing the bowl-shaped base. The second locking structure is sequentially divided into a vertical portion and a horizontal portion, wherein a second protrusion laterally extends from the horizontal portion of the second locking structure and an edge of the horizontal portion of the second structure extends toward an abutment between the peripheral wall and the horizontal portion of the first locking structure when the cover closing the bowl-shaped base. A pre-broken structure is formed on the second protrusion and includes a snapper formed on a back of the of the second protrusion and having an Ʊ-shaped cross-section. The snapper is engaged into the cavity when the cover closing the bowl-shaped base. A pre-broken line is formed on the second protrusion and surrounding the snapper, wherein the pre-broken line is damaged after detaching the cover from the bowl-shaped base.

Further benefits and advantages of the present invention will become apparent after a careful reading of the detailed description with appropriate reference to the accompanying drawings.

DETAILED DESCRIPTION OF THE INVENTION

Figure 1:
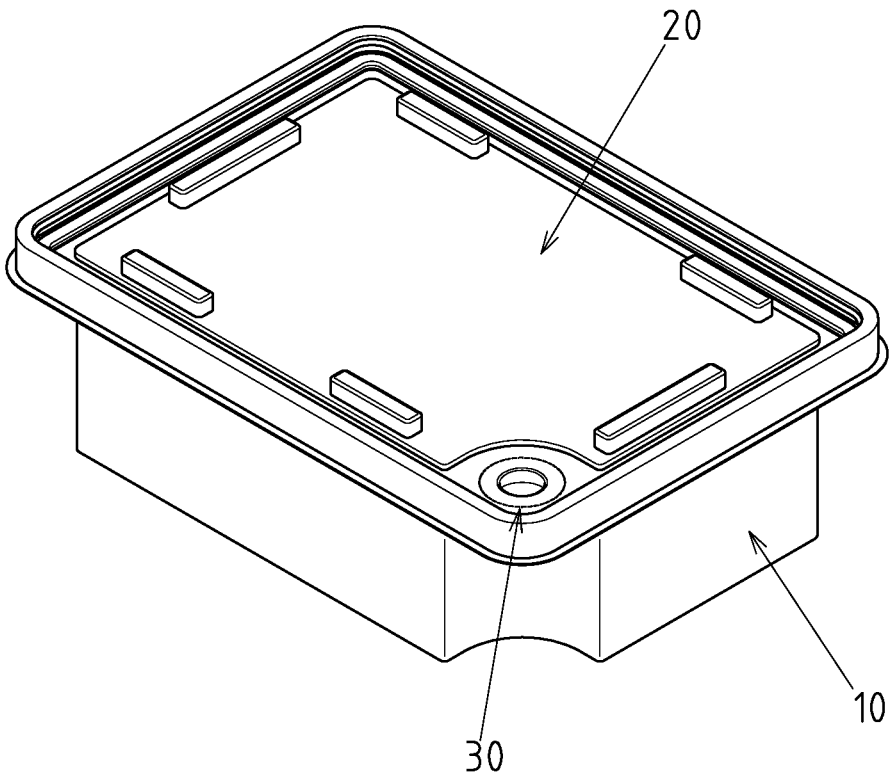
FIG. 1 is a perspective view of a container that prevents illegal operation and can be easily identified after being illegally operated in accordance with the present invention when the bowl-shaped base is closed by the cover.
Figure 2:
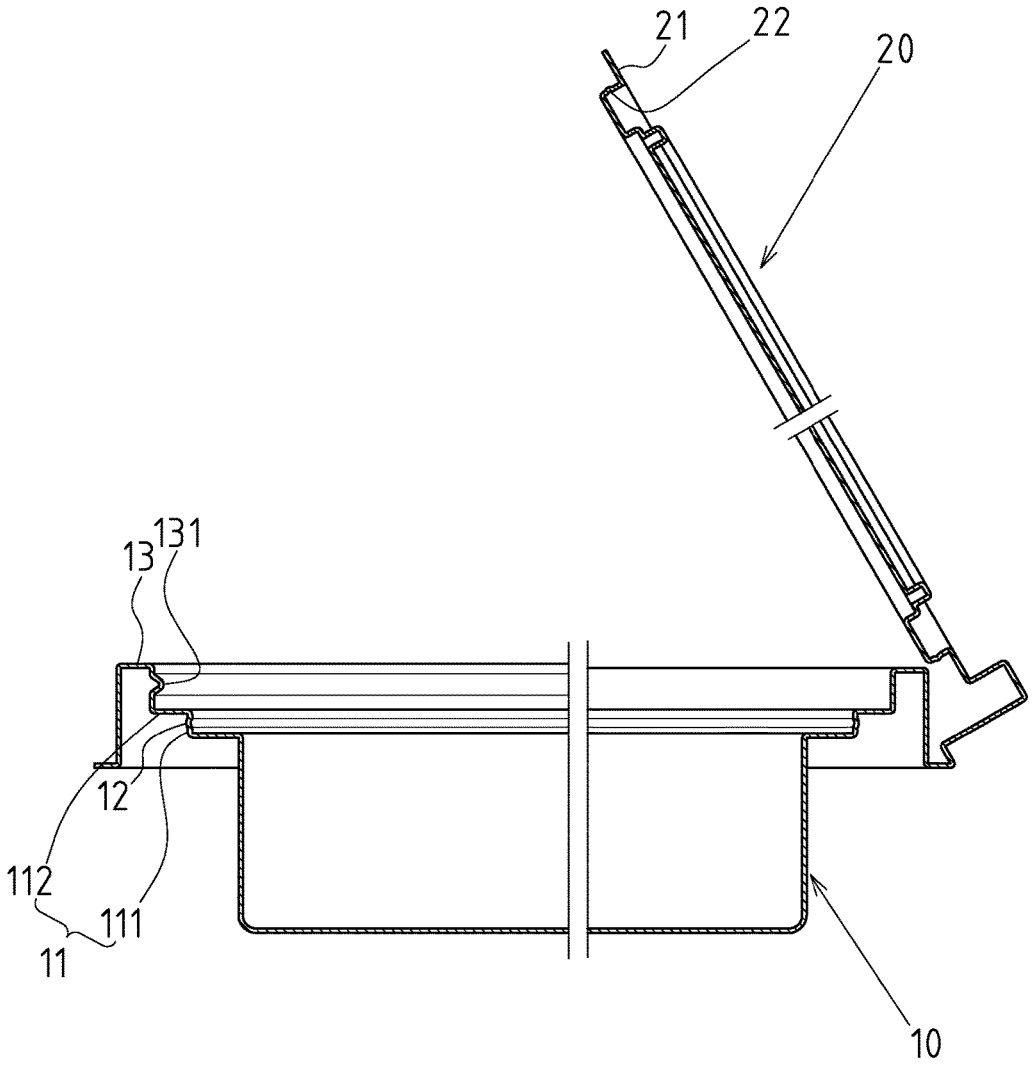
FIG. 2 is a side cross-sectional view of the container in FIG. 1 when the cover is detached from the bowl-shaped base.
Figure 3:
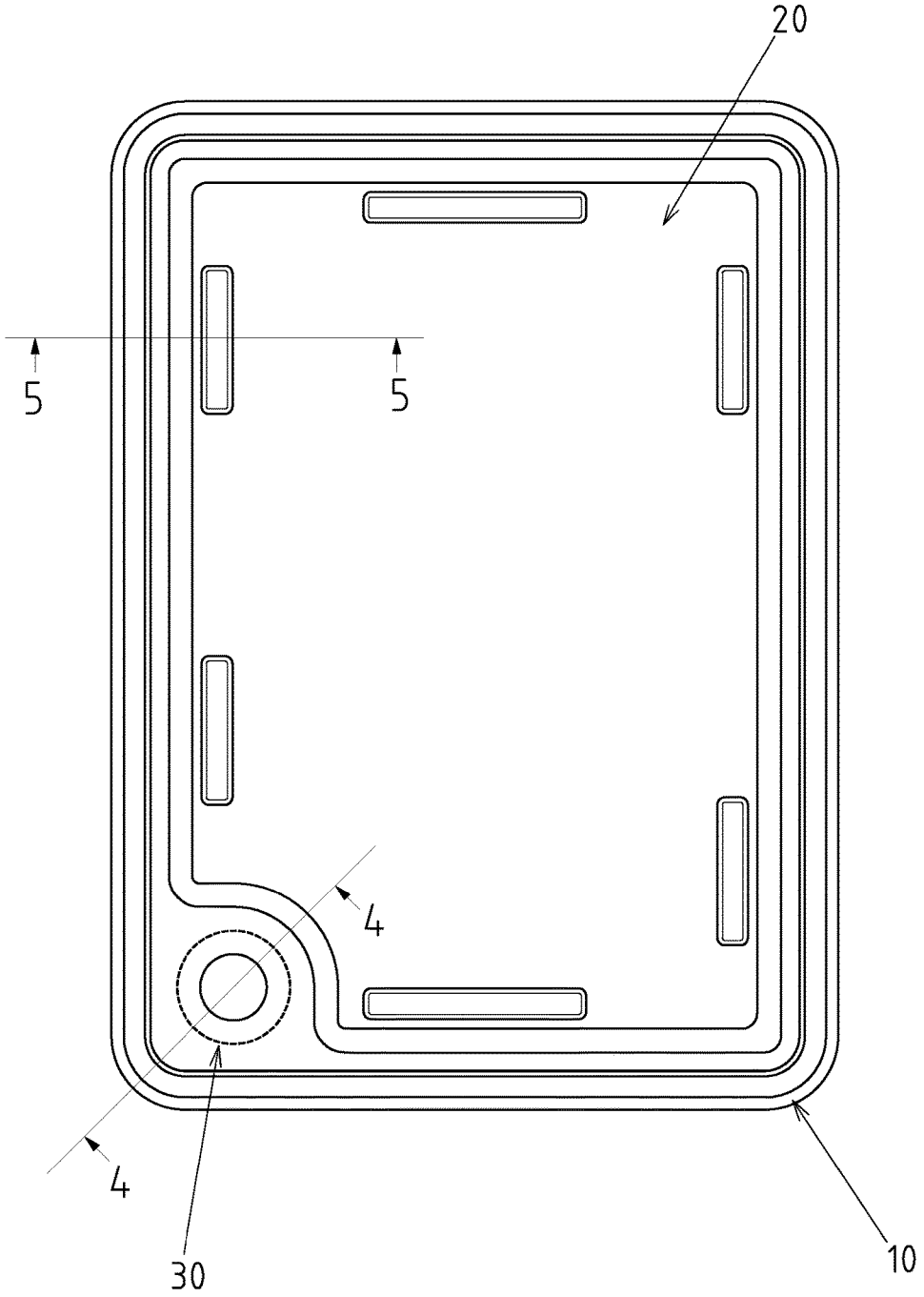
FIG. 3 is a top plan view of the container in FIG. 1.

Referring to the drawings and initially to FIGS. 1-5, a container, that prevents an illegal operation and can be easily identified after being illegally operated, in accordance with the present invention comprises a bowl-shaped base 10 and a cover 20 selectively closing the bowl-shaped base 10, wherein a pre-broken structure 30 is formed on the cover 20 and the cover 20 cannot be smoothly detached from the bowl-shaped base 10 before the pre-broken structure 30 being damaged. For the market, the salesperson easily confirms that the container has been illegally operated by his/her eyes and the illegally operated container is replaced in time for providing fresh good to the consumers. For the consumers, the illegally operated containers can be easily confirmed and eliminated through choosing for preventing from buying unsafe or stale goods, particularly foods.

The bowl-shaped base 10 has an opening (not numbered) defined therein and a stair-shaped first locking structure 11 surrounding the opening. The first locking structure 11 is sequentially divided into a vertical portion 111 and a horizontal portion 112, wherein a first locking portion 12 is peripherally formed on the vertical portion 111. A peripheral wall 13 outwardly extends from an edge of the horizontal portion 112 and has a rib 131 peripherally formed thereon. A first protrusion 14 laterally extends from the horizontal portion 112 of the first locking structure 11. A recess 15 is defined in the first protrusion 14 and a cavity 16 is defined in a bottom of the recess 15, wherein the cavity 16 has an Ʊ-shaped cross-section.

The cover 20 is provided to selectively close the opening in the bowl-shaped base 10. The cover 20 includes a stair-shaped second locking structure 21 peripherally formed thereon. The first locking structure 11 and the second locking structure 21 are complementally and air-tightly connected to each other when the cover 20 closing the bowl-shaped base 10. The second locking structure 21 is sequentially divided into a vertical portion (not numbered) and a horizontal portion (not numbered), wherein a second locking portion 22 is peripherally formed on the vertical portion of the second locking structure 21, and the second locking portion 22 is complementally and selectively connected to the first locking portion 12 when the cover 20 closing the bowl-shaped base 10. A second protrusion 23 laterally extends from the horizontal portion of the second locking structure 21, wherein the pre-broken structure 30 is formed on the second protrusion 23.

The pre-broken structure 30 includes a snapper 31 formed on a back of the of the second protrusion 23 and having an ?-shaped cross-section. The snapper 31 is engaged into the cavity 16 when the cover 20 closing the bowl-shaped base 10. A pre-broken line 32 is formed on the second protrusion 23 and surrounds the snapper 31, wherein the pre-broken line 32 is contained within an outline of the recess 15. With reference to FIG. 4A, a distance H between the snapper 31 and the bottom of the cavity 16 is not less than a deepness D of the recess 15.

Figure 4:
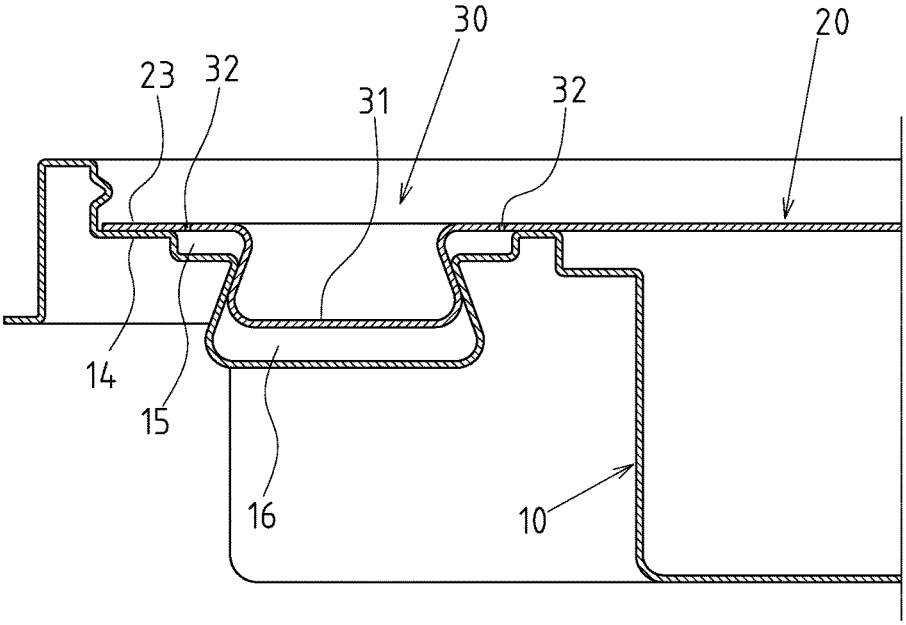
FIG. 4 is a cross-sectional view of the container along the line 4-4 in FIG. 3.
Figure 4A:
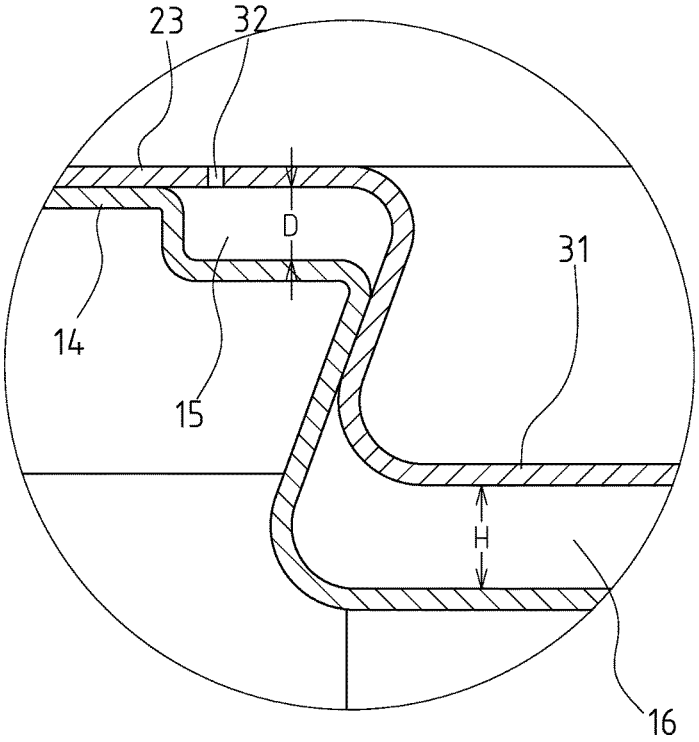
FIG. 4A is a partially enlarged view of FIG. 4.
Figure 5:
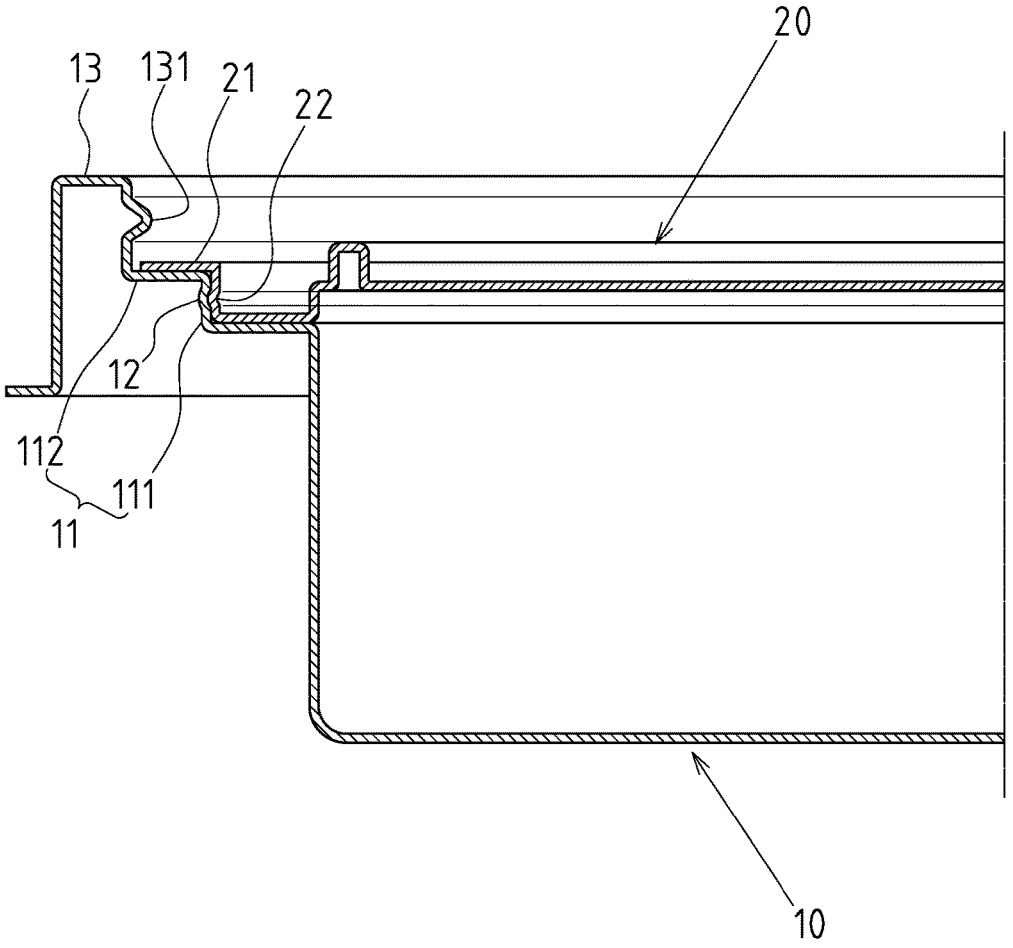
FIG. 5 is a cross-sectional view of the container along the line 5-5 in FIG. 3.

With reference to FIGS. 4 and 5, the horizontal portion 112 of the first locking structure 11 abuts the horizontal portion of the second locking structure 21, and an edge of the horizontal portion of the second structure 21 extends toward an abutment between the peripheral wall 13 and the horizontal portion 112 of the first locking structure 11 when the cover 20 firstly closing the bowl-shaped base 10. In addition, the first locking portion 12 and the second locking portion 22 are engaged to each other, and the snapper 31 of the pre-broken structure 30 is napped into the cavity 16 to hold the cover 20 in place and air-tightly close the bowl-shaped base 10. By such a manner, the cover 20 is hard to be detached from the bowl-shaped base 10 without damaging the pre-broken structure 30 because the fingertip of the gangster will be blocked by the peripheral wall 13 and the nail of the gangster can hook the edge of the horizontal portion of the second locking structure 21 when he/she wants to upwardly pick the edge of the horizontal portion of the second locking structure 21. In addition, the rib 131 on the peripheral wall 13 can prevent the edge of the horizontal portion of the second locking structure 21 from being pried by using a slim stick. Consequently, the salesperson can easily confirm that the container has been illegally operated and the illegally operated container is replaced in time for providing fresh good to the consumers and the illegally operated containers can be easily confirmed and eliminated through choosing by the consumers for preventing from buying unsafe or stale goods.

Figure 6:
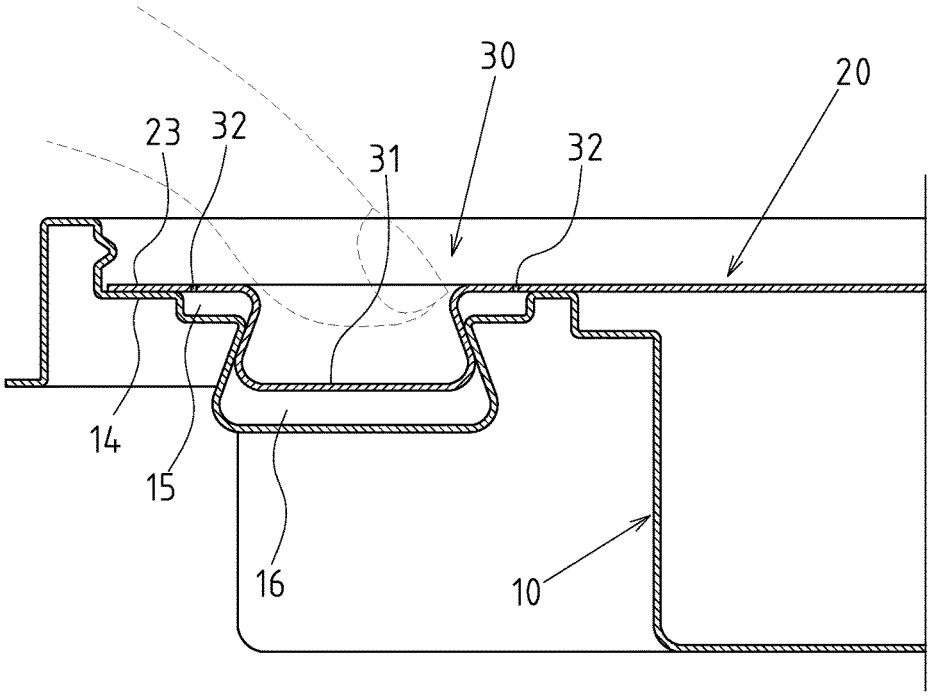
FIGS. 6, 7 and 8 are operational views of the container in accordance with the present invention.
Figure 7:
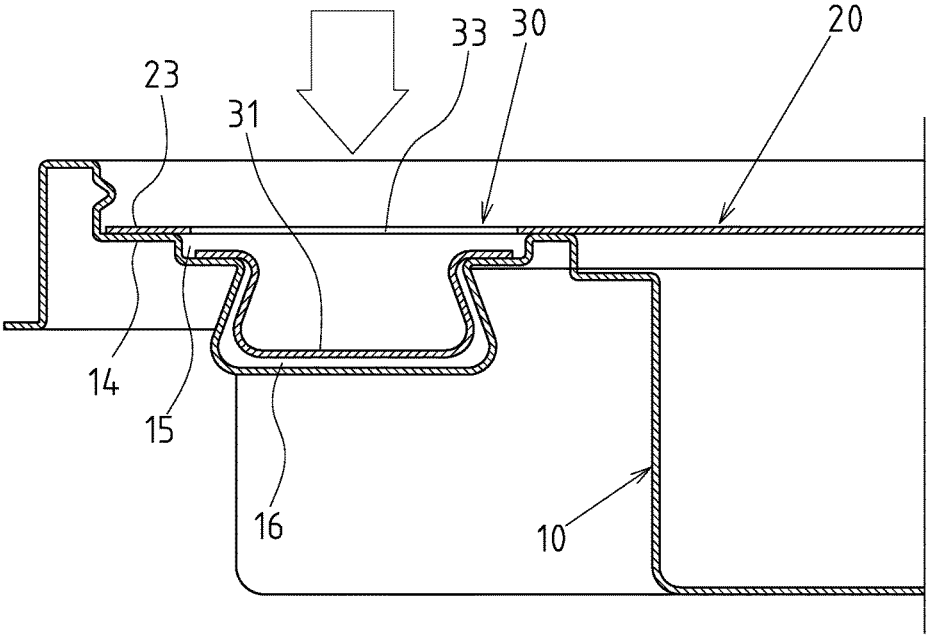

With reference to FIGS. 6 and 7, the consumer only needs to press the area surrounded by the pre-broken line 32 and damage the pre-broken line 32 when opening the cover 20 at home. A part, formed by the pre-broken line 32, of the second protrusion 23 falls down with the snapper 31 to define a through hole 33 because the distance H between the snapper 31 and the bottom of the cavity 16 is not less than the deepness D of the recess 15. As a result, the operator can easily upwardly lift and open the cover 20 by hooking the edge of the through hole 33, as shown in FIG. 8.

Figure 8:
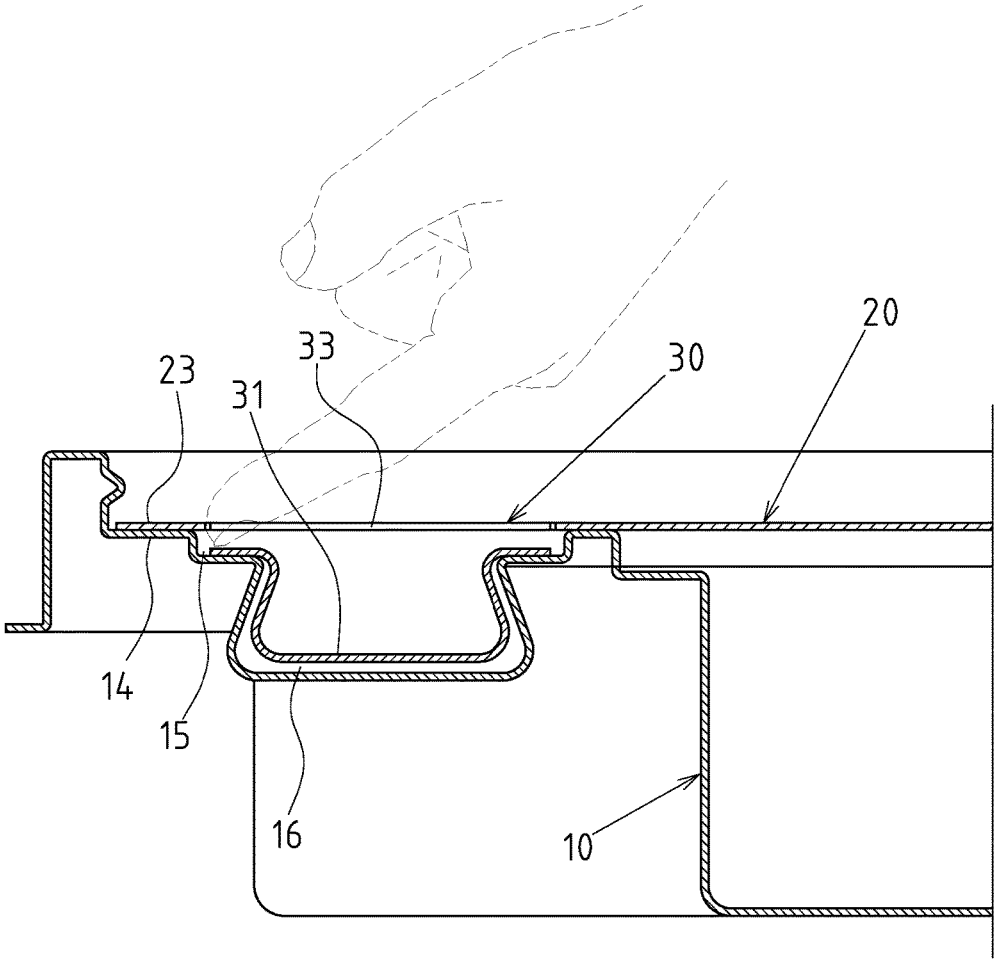

With reference to FIG. 8 that shows a second embodiment of the pre-broken structure 30 in accordance with the present invention, in this embodiment, the structures of the bowl-shaped base 10A and the cover 20A is similar to that of the first embodiment of the bowl-shaped base 10 and the cover 20. However, the bowl-shaped base 10A does not define the recess 15 and the pre-broken line 32 is formed on the connection between the snapper 31 and the second protrusion 23, wherein the second embodiment of the pre-broken structure 30 can achieve the purposes of the above embodiment.

Figure 9:
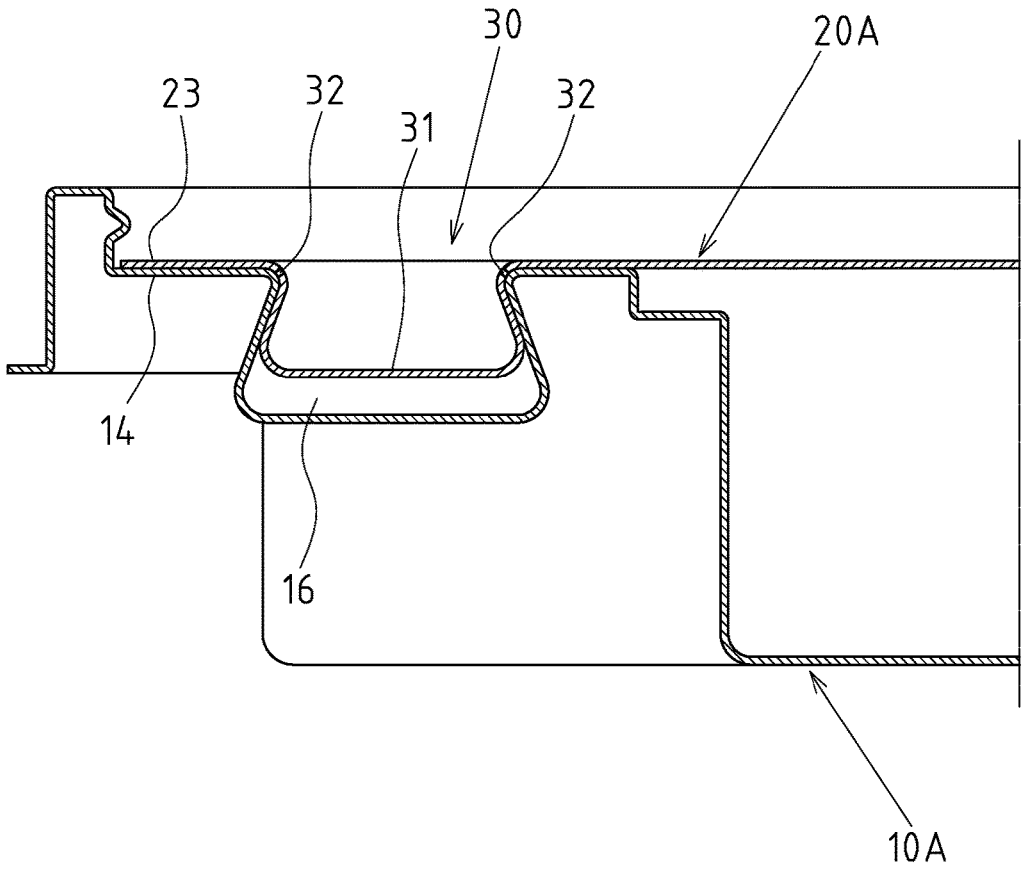
FIG. 9 is a cross-sectional view of a second embodiment of the pre-broken structure of the container in accordance with the present invention.
Figure 10:
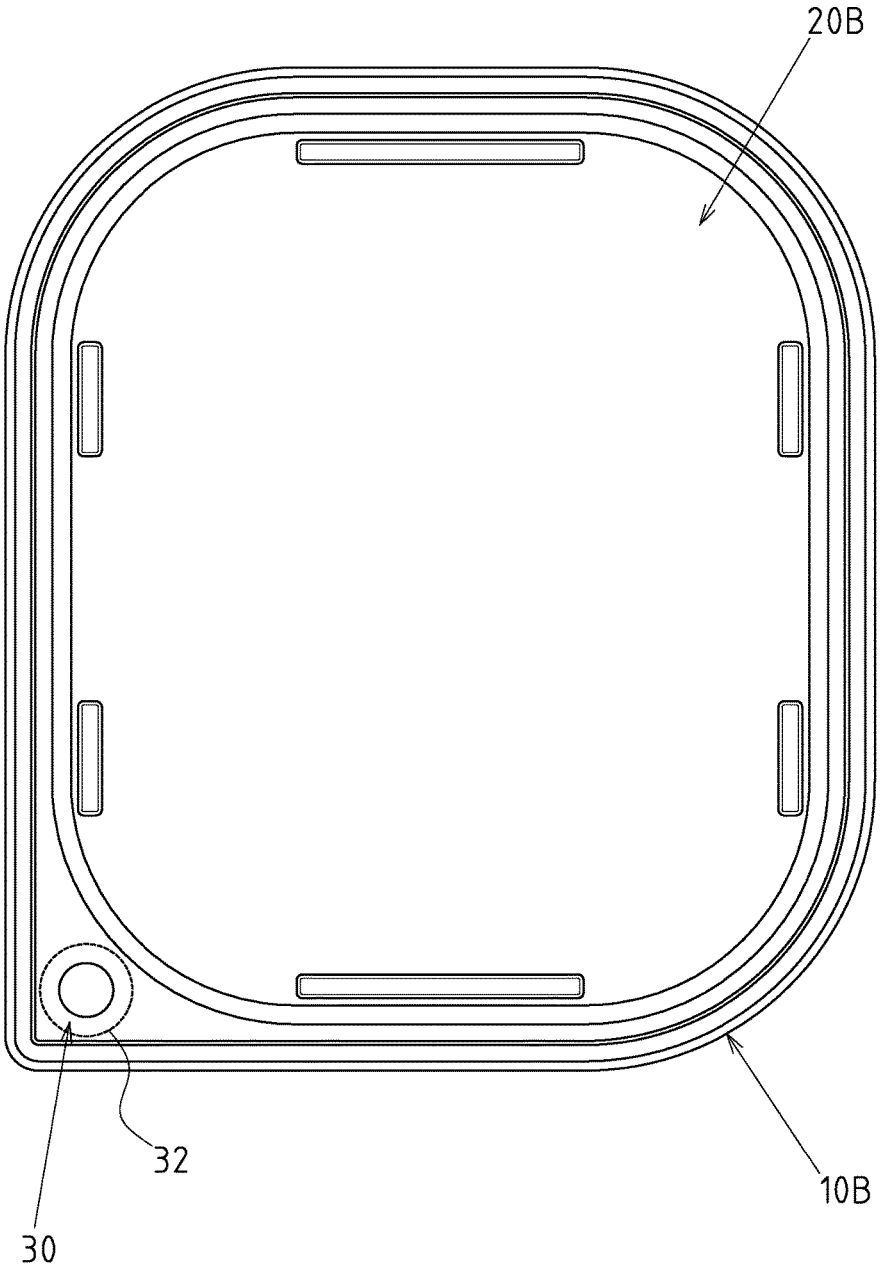
FIG. 10 is a top plan view of a second embodiment of the container in accordance with the present invention.

With reference to FIG. 9 that shows a second embodiment of the bowl-shaped base 10B and the cover 20B, in the embodiment, only the shapes of the bowl-shaped base 10B and the cover 20B are change for providing a complete containing space to the bowl-shaped base 10 to receive more goods.

Although the invention has been explained in relation to its preferred embodiment, it is to be understood that many other possible modifications and variations can be made without departing from the spirit and scope of the invention as hereinafter claimed.

I claim:

1. A container that prevents tampering and which indicates an occurrence of the tampering, the container comprising:

a bow-shaped base having an opening defined therein and a stair-shaped first locking structure surrounding the opening, said first locking structure sequentially divided into a vertical portion and a horizontal portion, said horizontal portion having a peripheral wall extending outwardly of an edge thereof and having a first protrusion extending laterally therefrom, said first protrusion having a cavity defined therein, said cavity having an Ʊ-shaped cross-section;

a cover selectively closing the opening of said bowl-shaped base, said cover having a stair-shaped second locking structure peripherally formed thereon, said first locking structure and said second locking structure being complementarily connected in air-tight relation when said cover closes said bowl-shaped base, said second locking structure being sequentially divided into a vertical portion and a horizontal portion, said horizontal portion having a second protrusion extending laterally therefrom, said horizontal portion having an edge extending toward an abutment between said peripheral wall and said horizontal portion of said first locking structure when said cover closes said bowl-shaped base; and a pre-broken structure formed on said second protrusion, said pre-broken structure having a snapper formed on a back of said second protrusion and having an Ʊ-shaped cross-section, said snapper engaged into said cavity when said cover closes said bowl-shaped base, said second protrusion having a pre-broken line formed thereon and surrounding said snapper.

2. The container of claim 1, said pre-broken line formed on a connection between said snapper and said second protrusion.

3. The container of claim 1, said bowl-shaped base having a recess defined in said first protrusion, said cavity being defined in a bottom of said recess, a distance formed between said snapper and the bottom of said cavity.

4. The container of claim 2, said bowl-shaped base having a recess defined in said first protrusion, said cavity being defined in a bottom of said recess, a distance formed between said snapper and the bottom of said cavity.

5. The container of claim 3, said pre-broken line surrounding said snapper and being contained within an outline of said recess.

6. The container of claim 4, said pre-broken line surrounding said snapper and being contained within an outline of said recess.

7. The container of claim 3, the distance being not less than a depth of said recess.

8. The container of claim 4, the distance being not less than a depth of said recess.

9. The container of claim 5, the distance being not less than a depth of said recess.

10. The container of claim 6, the distance being not less than a depth of said recess.

* * * * *